US007740229B2

(12) United States Patent
Taylor

(10) Patent No.: US 7,740,229 B2
(45) Date of Patent: Jun. 22, 2010

(54) LOG CRADLE FOR LIFTING LOGS

(76) Inventor: George Floyd Taylor, 314 Rocky Creek Rd., Hampton, GA (US) 30228-2447

( * ) Notice: Subject to any disclaimer, the term of this patent is extended or adjusted under 35 U.S.C. 154(b) by 29 days.

(21) Appl. No.: 11/825,073

(22) Filed: Jul. 5, 2007

(65) Prior Publication Data

US 2009/0008616 A1 Jan. 8, 2009

(51) Int. Cl.
*B66F 3/00* (2006.01)
*B66D 1/00* (2006.01)

(52) U.S. Cl. ..... 254/134; 254/264

(58) Field of Classification Search ..... 254/30, 254/131, 132, 134, 269
See application file for complete search history.

(56) References Cited

U.S. PATENT DOCUMENTS 28,856 A * 6/1860 Hamlyn ..... 254/124

6,866,249 B1 * 3/2005 Campbell et al. ..... 254/93 R

* cited by examiner

*Primary Examiner*—Hadi Shakeri

(57) ABSTRACT

A log lifting beam with structural attachments that allow it to be fastened to a downed tree trunk. A means is provided for coupling the beam to a portable jack. The beam is positioned on a downed tree trunk with its forward end resting perpendicularly on the top of the tree trunk. The lower end of the beam rests on the ground. A tongue assembly hangs downward from the forward end of the beam. A steel chain stretched from the lower end of the tongue assembly and extended under the tree trunk to an attachment point mid-section the beam serves as a cradle for the tree trunk. The tongue of a jack is inserted under a short chain also bolted to the lower end of the said tongue assembly. The jack tongue is raised against this chain and the downed tree trunk is lifted.

1 Claim, 4 Drawing Sheets

LOG CRADLE FOR LIFTING LOGS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE, A TABLE, OR A COMPUTER PROGRAM LISTING COMPACT DISC APPENDIX

Not Applicable.

BACKGROUND OF THE INVENTION

This invention relates to equipment that assist in the lifting of a fallen tree trunk off the ground for the purpose of cutting it to firewood length or for other purposes. This invention can be categorized as a jack accessory.

When a tree is cut down for the purpose of cutting firewood or logs, getting the tree trunk off the ground so it can be sawed is generally a challenge for those without heavy equipment. Jamming one end of a wooden pole under a tree trunk and then placing a short piece of log under the tree end of the pole so that leverage can be created by pushing down on the other end of the pole is the usual method used for lifting a tree trunk off the ground in order to get something under it. This is time consuming and may require two people and does not always work.

A common tool for rotating and lifting small diameter logs off the ground is called a timberjack. This tool is essentially a cant hook with a stand. You can only get a limited amount of leverage with this device and so, therefore, it is not useful for large logs.

Tripod type rigs that straddle a downed tree trunk and utilize a hoisting device have been used to lift tree trunks off the ground. These devices are unstable on uneven terrain and in order to lift a lot of weight they must be large and heavy. This causes them to become unwieldy.

BRIEF SUMMARY OF THE INVENTION

Accordingly I claim the following as objects and advantages of the invention: To provide a light weight device that will couple a simple portable jack to the trunk of a downed tree for the purpose of lifting the tree trunk off the ground, to provide a device that can easily and quickly be securely attached to a downed tree trunk, to provide a device that cannot be pulled loose from the tree trunk, to provide a device that is very stable when under a heavy load, to provide safe performance.

In addition, I claim the following additional advantages: this invention couples the extreme lifting power of a hand operated portable jack to a heavy downed tree trunk weighting thousands of pounds. Tripod rigs that straddle a downed tree trunk and rely on a hoisting device to provide lift cannot provide the same lifting capacity without being very large, heavy and unwieldy. Tripod rigs generally require even and non-slopping terrain. My invention functions well on uneven and sloping terrain. My invention only takes up slightly more storage space than a logger's cant hook. My invention requires only one person to operate it. Using the leverage of a wooden pole generally requires two people. One person is needed to push down on one end of the pole while another places something under the tree trunk to hold it off the ground. This method has limited lifting capacity.

DRAWING REFERENCE NUMBERS

20—3"×2"×31" metal tube
22—2"×2"×30" angle iron
24—⅜"×4" bolt
26—⅜"×4" bolt
28—2"×2"×19" angle iron base piece
30—⅜"×1½" bolt
32—1¾"×1¾"×24" angle iron
34—1¾"×1¾"×24" angle iron
36—½"×3½" bolt
38—1¾"×1¾"×5½" angle iron brace piece
40—5/16"×13" short lift chain
42—⅜"×1½" bolt
44—⅜"×1½" bolt
46—5/16"×65" long lift chain
48—½"×2" bolt
50—⅜"×2" bolt
52—3/16"×66" auxiliary chain
54—⅜"×2" bolt

DETAILED DESCRIPTION OF THE INVENTION

Figure 1:
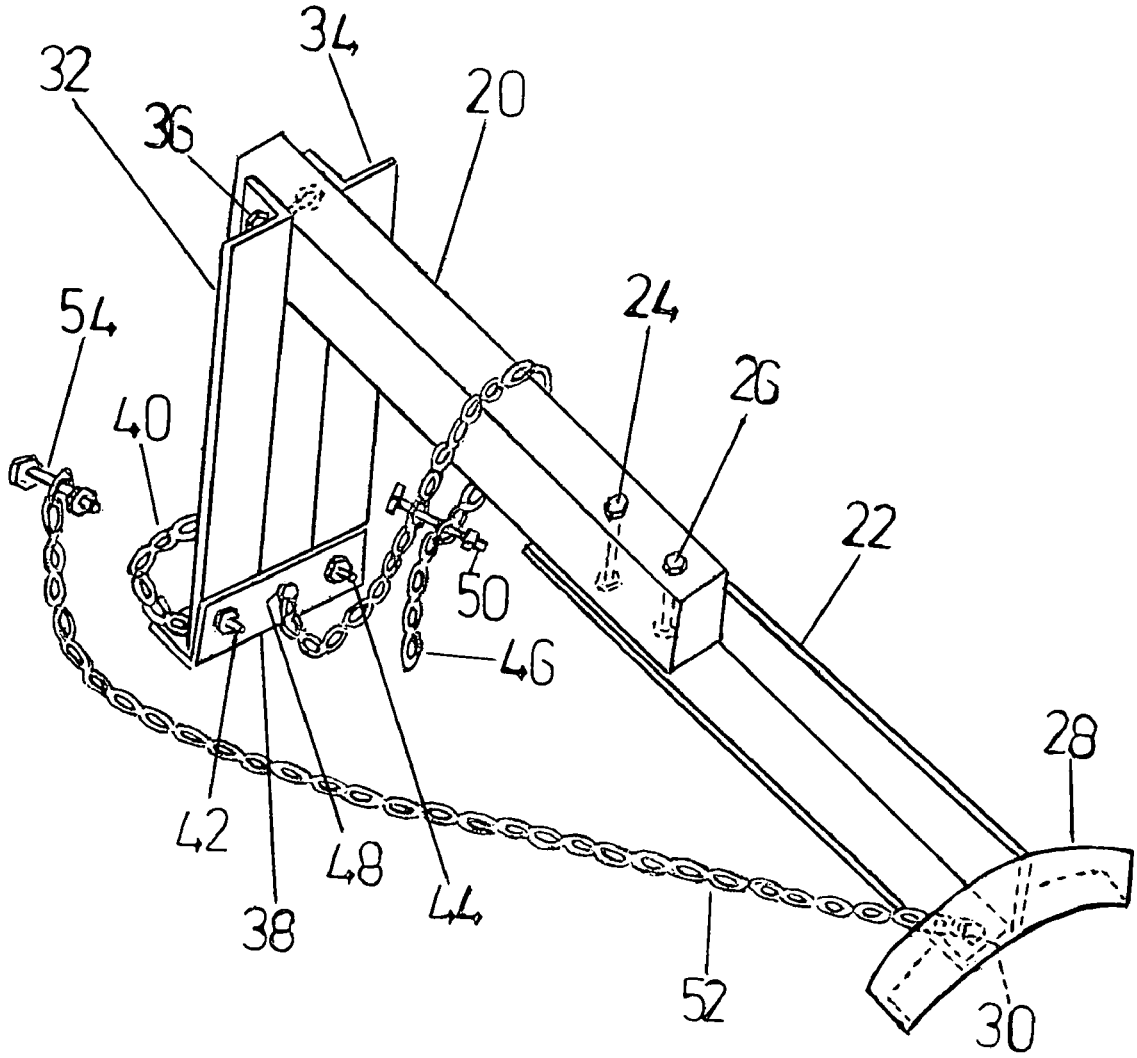
FIG. 1 shows the preferred embodiment of the Log Cradle in its entirety.

FIG. 1 shows the preferred embodiment of the invention. As shown in FIG. 1, the backbone of this invention is a beam assembly which is made up of the two parts 20 and 22. Part 20 is a 3" by 2" by 31" rectangular metal tube. It is ⅛" thick. Bolted to the rearward portion of part 20 is a 2" by 2" by 30" piece of angle iron part 22. Part 22 is ¼" thick. As shown in FIG. 1, the coupling of part 20 to part 22 is achieve per two ⅜" by 4" bolts 24 and 26.

As shown in FIG. 1, the Log Cradle's ground base 28 is attached perpendicularly to the rear end of part 22. Part 28 is a 2" by 2" by 19" piece of angle iron. Part 28 is ¼" thick. As shown in FIG. 1, part 28 is attached to the rear end of part 22 per a single ⅜" by 1½" bolt 30. As shown in FIG. 1, part 28 is not straight but is bent so it has a rather pronounced downward curve in it.

As shown in FIG. 1, there are two pieces of 1¾" by 1¾" by 24" angle iron, parts 32 and 34, attached to the forward end of part 20 per a single ½" by 3½" bolt 36. Parts 32 and 34 are 3/16" thick. As shown in FIG. 1, the lower ends of parts 32 and 34 are secured parallel to each other by a 1¾" by 1¾" by 5½" piece of angle iron 38. Part 38 is 3/16" thick. As shown in FIG. 1 part 38 is attached to the lower ends of parts 32 and 34 per two ⅜" by 1½" bolts 42 and 44.

Figure 3:
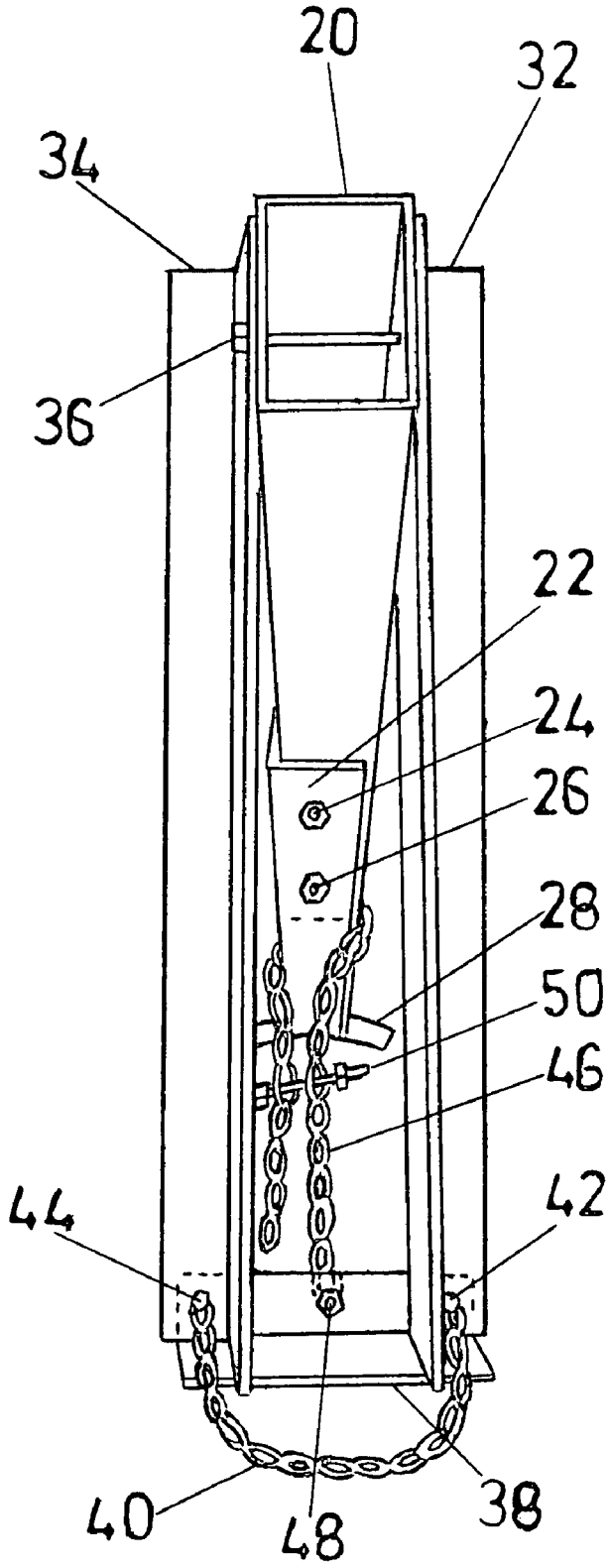
FIG. 3 shows a direct frontal view of the Log Cradle.

As shown in FIGS. 1 and 3, the short lift chain 40 is also attached to the lower ends of parts 32 and 34 per the two above mentioned bolts 42 and 44. The short lift chain 40 is 5/16" thick by 13" long.

As shown in FIG. 1, one end of the long lift chain 46 is attached to part 38 per the ½" by 2" bolt 48. The other end of the long lift chain 46 is wrapped around the beam assembly and is tied off with the ⅜" by 2" bolt 50. As stated earlier, the beam assembly is made up of parts 20 and 22. The long lift chain 46 is 5/16" thick and 65" long.

As shown in FIG. 1, the auxiliary chain 52 is attached to the rear end of part 22 per the ⅜" by 1½" bolt 30. This is the same point where the ground base 28 is attached. The forward end of the auxiliary chain 52 utilizes a ⅜" by 2" bolt 54. The auxiliary chain 52 is 3/16" thick by 66" long.

Figure 2:
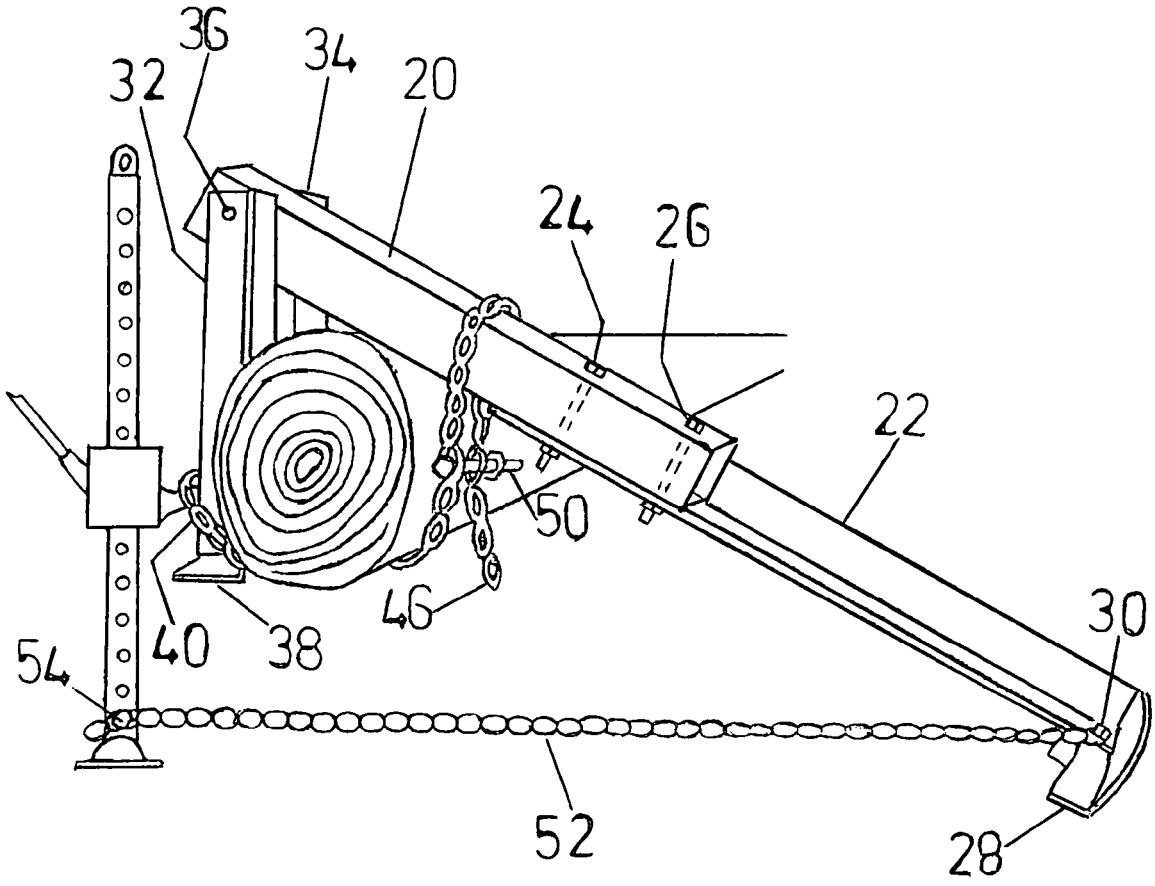
FIG. 2 shows the Log Cradle in operation.

In regards to the proper operation of the Log Cradle, FIG. 2 shows the Log Cradle properly attached to a downed tree trunk. The Log Cradle serves as a means of coupling a simple portable jack to a downed tree trunk for the purpose of lifting the tree trunk off the ground. As shown in FIG. 2, the Log Cradle's beam assembly (parts 20 and 22) is positioned across the top of a downed tree trunk with the Log Cradle's base 28 remaining on the ground.

As shown in FIG. 1, the tongue assembly is made up of parts 32, 34, 36, 38, 42, 44, 48 and 40. As shown in FIG. 2, the tongue assembly is attached to the raised end of the beam assembly and is slung downward and pulled snugly against the side of the tree trunk per the long lift chain 46. As shown in FIG. 1, the long lift chain 46 is bolted to part 38 per bolt 48. From this secured position the long lift chain 46 is run underneath the tree trunk and up to the beam assembly. As shown in FIG. 2, the loose end of the long lift chain 46 is wrapped around the beam assembly and tied off per bolt 50.

With the Log Cradle properly secured in the position as shown in FIG. 2, the tongue of a high lift style jack can be inserted under the short lift chain 40. As shown in FIG. 3, the ends of the short lift chain 40 are attached to the lower ends of parts 32 and 34 of the tongue assembly per bolts 42 and 44. As the jack tongue is raised against the short lift chain 40 the trunk of the tree is lifted off the ground.

Figure 4:
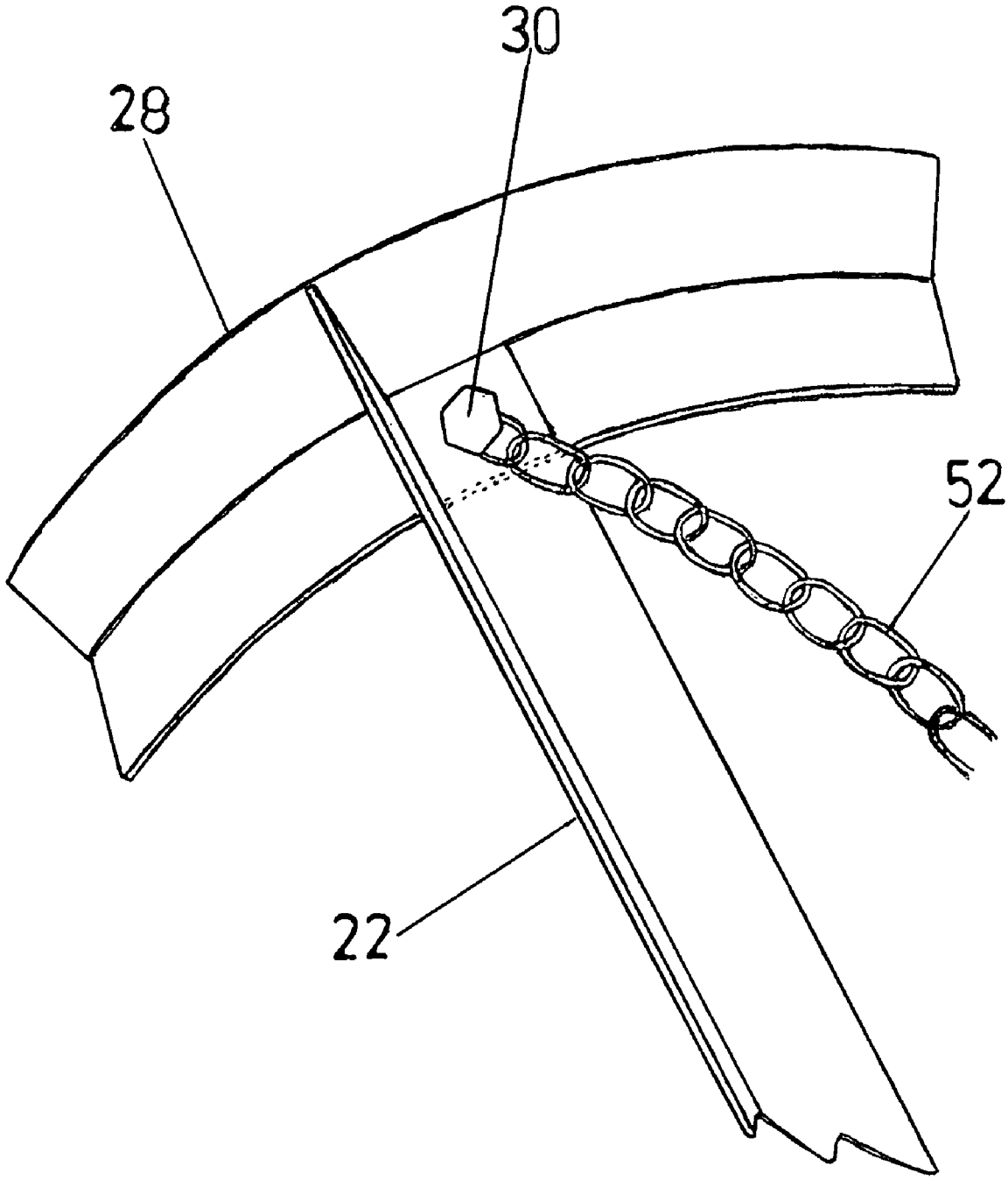
FIG. 4 shows a close up view of the rear base portion of the Log Cradle.

As shown in FIG. 4, the Log Cradle's ground base 28 is bent so that it has a very pronounced downward curve. As weight is applied to the Log Cradle's ground base 28 per the jack lifting the tree, the outer edges of the downward curved angle iron ground base 28 quickly bite into the ground and thus provide a secured anchoring point for the Log Cradle.

When the Log Cradle is used in the field, conditions vary greatly. Should the Log Cradle's ground base 28 creep away from its initial anchoring point the jack will be pulled from its straight up position to a unwanted angle. This problem is corrected per the auxiliary chain 52. As shown in FIG. 2, one end of auxiliary chain 52 is bolted at the Log Cradle's ground base 28 per bolt 30 and from there the auxiliary chain 52 is run under the tree trunk and either bolted directly to the bottom of the jack leg per bolt 54 or wrapped around the bottom of the jack leg and tied off per bolt 54. Now, if the Log Cradle's ground base 28 loses its grip on the earth and moves, the lower end of the jack is pulled with the Log Cradle's base 28 and as a result the jack remains in a straight up position. For the purpose of cutting firewood or logs there is generally no point in lifting a tree trunk off the ground more than a foot at the jack position. However, the Log Cradle, coupled with a high lift style jack, can lift a very large tree much higher.

I claim:

1. A lifting beam assembly in combination with a portable jack for lifting a downed tree trunk off the ground, the combination comprising:

a lifting beam assembly comprising an elongated beam having a forward end, a mid section and a rear end, a downwardly bent ground anchoring base coupled to the rear end of the elongated beam for providing a ground support at a rear end of the assembly, a pair of parallel beams each having an upper portion pivotally secured to a respective side of the forward end of the elongated beam straddling the elongated beam at either side and each having a lower end secured to a base plate for providing a support at a forward end of the assembly, a lift chain having two ends each attached to a respective lower end of the parallel beams forming a loop, an elongated lift chain having one end attached to the base plate and a free end for attachment to the mid section of the elongated beam, an auxiliary chain having one end secured to the rear end of the elongated beam and a free end; and a portable jack having a base and a tongue;

wherein the free end of the elongated lift chain is extended under a tree trunk and wrapped around the mid section of the beam and tied off to secure the trunk to the elongated beam, the loop of the lift chain is secured to the tongue of the jack, and the free end of the auxiliary chain is secured to a lower end of the jack adjacent to the base providing a stable mechanism for lifting a down tree trunk.

* * * * *